US006098726A

United States Patent [19]

Taylor et al.

[11] Patent Number: 6,098,726

[45] Date of Patent: Aug. 8, 2000

[54] TORQUE TRANSMITTING DEVICE FOR ROTARY DRILL BITS

[75] Inventors: Malcolm Roy Taylor, Gloucester; David John Jelley, Cheltenham; Andrew Murdock, Stonehouse; Brian Peter Jarvis, Bristol, all of United Kingdom

[73] Assignee: Camco International (UK) Limited, Stonehouse, United Kingdom

[21] Appl. No.: 09/158,201

[22] Filed: Sep. 22, 1998

[51] Int. Cl.[7] ..... E21B 17/04

[52] U.S. Cl. ..... 175/320; 464/20; 464/76; 464/86

[58] Field of Search ..... 175/320, 327; 464/20, 76, 86, 73, 97

[56] References Cited

U.S. PATENT DOCUMENTS 2,740,651 4/1956 Ortloff .

3,033,011 5/1962 Garrett ..... 464/20

3,265,091 8/1966 Jarnett ..... 138/114

*Primary Examiner*—David Bagnell

*Assistant Examiner*—Zakiya Walker

*Attorney, Agent, or Firm*—Jeffery E. Daly

[57] ABSTRACT

A torque transmitting device for use with a rotary drill bit connected to a drill collar, comprises a first member connected to the drill collar, a second member connected to the drill bit, and coupling means connecting the two members together for rotation about a common central axis. The coupling means permits limited relative rotation between the members about the axis, but provides a resistance to rotation of the first member relative to the second member in a forward drilling direction which is greater than its resistance to relative rotation in the reverse direction. The comparatively lower resistance to rotation in the reverse direction prevents momentary reverse rotation of the drill collar, due for example to torsional oscillations, being transmitted to the drill. bit. This reduces the likelihood of damage to the cutters on the drill bit, which might otherwise result from such momentary reverse rotation of the bit.

18 Claims, 3 Drawing Sheets

TORQUE TRANSMITTING DEVICE FOR ROTARY DRILL BITS

BACKGROUND OF THE INVENTION

1. Field of the Invention

The invention provides a device for transmitting torque to a rotary drill bit when drilling a borehole in subsurface formations. The device is for use in drilling systems where the drill bit is mounted on a drill collar in a bottom hole assembly mounted on a drill string which is rotated at the surface, the rotation being transmitted to the drill bit through the drill string and drill collar.

2. Description of Related Art

The invention is particularly, but not exclusively, applicable to rotary drag-type drill bits of the kind comprising a bit body having a shank for connection to a drill collar on the drill string, a plurality of cutters mounted on the bit body, and means for supplying drilling fluid to the surface of the bit body to cool and clean the cutters and to carry cuttings to the surface. In one common form of bit some or all of the cutters are preform (PDC) cutters each comprising a tablet, usually circular or part circular, made up of a superhard table of polycrystalline diamond, providing the front cutting face of the element, bonded to a substrate, which is usually of cemented tungsten carbide.

While such PDC bits have been very successful in drilling relatively soft formations, they have been less successful in drilling harder formations or soft formations which include harder occlusions or stringers. Although good rates of penetration are possible in harder formations, the PDC cutters may suffer accelerated wear and bit life can be too short to be commercially acceptable.

Studies have suggested that the rapid wear of PDC bits in harder formations is due to chipping of the cutters as a result of impact loads caused by vibration. This may be torsional vibration of the drill string, for example as a result of the natural frequency of torsional vibration of the drill string being excited by forces generated by the bottom hole assembly and, in particular, by the drill bit.

Torsional vibration can have the effect that cutters on the drill bit may momentarily be rotating backwards, i.e. in the reverse rotational direction to the normal forward direction of rotation of the drill bit during drilling. It is believed that it is this backward rotation which may be causing excessive damage to the cutters of PDC bits when drilling harder formations where torsional vibration is more likely to occur. The effect of reverse rotation on a PDC cutter may be to impose unusual loads on the cutter which tend to cause spalling or delamination, i.e. separation of part or all of the polycrystalline diamond facing table from the tungsten carbide substrate.

The present invention sets out to overcome this phenomenon by providing in the drill string a torque transmitting device which reduces the likelihood of reverse rotation of the cutters occurring. This is effected by damping out the torsional vibrations to such an extent that any momentary backward rotation of the drill bit is overcome by the forward rotational speed. Also, means are provided to prevent momentary backward rotation of the drill string being transmitted to the drill bit itself.

SUMMARY OF THE INVENTION

According to the invention there is provided a torque transmitting device for use with a rotary drill bit connected to a drill collar, comprising:

a first member for connection to the drill collar, a second member for connection to the drill bit, coupling means connecting the first and second members together for rotation about a common central axis, said coupling means permitting limited relative rotation between the members about said axis, and said coupling means providing a resistance to rotation of the first member relative to the second member in a forward drilling direction which is greater than its resistance to relative rotation in a reverse direction.

In use, therefore, the coupling means normally transmits torque from the drill collar to the drill bit in view of the high resistance to relative rotation in the forward direction between the two members of the device. However, should momentary reverse rotation of the drill collar occur, for example as a result of torsional vibrations in the drill string, the coupling means allows the first member of the device to rotate in the reverse direction relatively to the second member, due to its low resistance to such rotation, thereby preventing such reverse rotation being transmitted to the second member and hence to the drill bit.

Preferably the coupling means provides substantially no restraint to rotation of the first member relative to the second member in the reverse direction, other than frictional restraint arising from relative rotation between components of the device.

The coupling means may include resiliently flexible means to oppose rotation of the first member relative to the second member in said forward drilling direction and to transmit torque to the second member in that direction. The resiliently flexible means may comprise at least one body of resiliently flexible material disposed between abutments on the first and second members respectively. For example, the body of resiliently flexible material may provide resistance to movement of said abutments towards one another, but less or no resistance to movement of the abutments away from one another. Thus, one or both of the abutments may be unattached to the body of resiliently flexible material, so that the body may separate from one or both of the abutments as they move apart.

The abutments may comprise outwardly extending radial vanes on one member interspaced between inwardly extending radial vanes on the other member. The vanes and body of resiliently flexible material may extend generally parallel to the common central axis of the members.

The above arrangements in which resiliently flexible means are provided to oppose relative rotation between the members in the forward drilling direction is preferred, since the resiliently flexible means will tend to damp any torsional vibrations in the drill string and prevent their transmission to the drill bit itself However, the invention includes within its scope any arrangement according to the invention, as first defined, wherein said coupling means include abutments, on the two members respectively, which transmit torque from the first member to the second member in the forward drilling direction, but which abutments are freely separable upon rotation of the first member in the reverse direction relative to the second member.

In a second aspect of the invention there is provided a torque transmitting device for use with a rotary drill bit connected to a drill collar, comprising:

a first member for connection to the drill collar, a second member for connection to the drill bit, coupling means connecting the first and second members together for rotation about a common central axis, said coupling means including a rotationally flexible torsion bar extending substantially coaxially with the common central axis of the two members. In this case the torsion bar may serve to damp out torsional vibration of the drill string and prevent the transmission of such vibration to the drill bit.

In this case the coupling means may include stop means to limit the angular extent of relative rotation between the members.

In one embodiment, one of said members has an axially extending tubular portion and the torsion bar extends longitudinally inside the tubular portion.

In this arrangement the coupling means may also include resiliently flexible means connecting the torsion bar to the tubular portion. The resiliently flexible means may comprise at least one body of resiliently flexible material attached, for example bonded, to the torsion bar and tubular portion respectively.

In a third aspect of the invention there is provided a torque transmitting device for use with a rotary drill bit connected to a drill collar, comprising:

a first member for connection to the drill collar, a second member for connection to the drill bit, coupling means connecting the first and second members together for rotation about a common central axis, said coupling means including an axial shaft on one member extending substantially coaxially within a tubular portion on the other member, and resiliently flexible means connecting the axial shaft to the tubular portion.

The resiliently flexible means may comprise at least one body of resiliently flexible material attached, for example bonded, to the torsion bar and tubular portion respectively. Said body of material may substantially fill an annular space between the axial shaft and the tubular portion.

In any of the arrangements according to the invention the two members of the device may include one or more pairs of frictionally engaging surfaces which slide relatively over one another upon relative rotation between the members. The frictionally engaging surfaces further serve to damp out torsional vibrations in the drill string and prevent their taansmission to the drill bit.

Other damping arrangements may be provided, such as hydraulic damping where relative rotation between the members of the device causes flow of fluid through tortuous path, such as a restricted aperture.

DETAILED DESCRIPTION OF THE PREFERRED EMBODIMENTS

Figure 1:
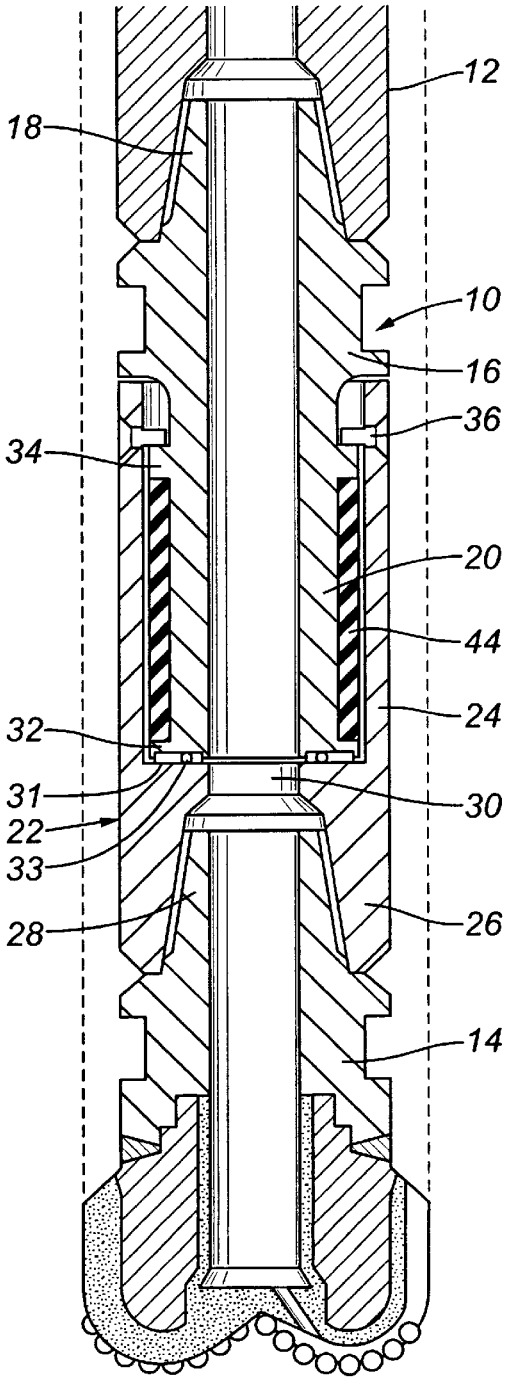
FIG. 1 is a diagrammatic longitudinal section through one form of torque transmiting device according to the invention.
Figure 2:
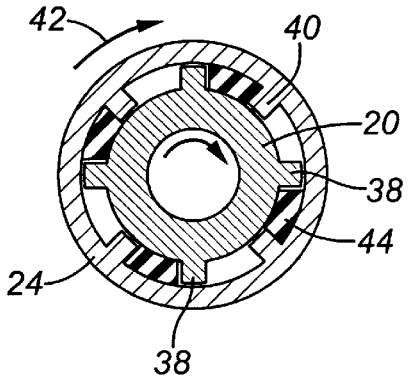
FIG. 2 is a sectional view of the torque transmitting device of FIG. 1.

Referring to FIGS. 1 and 2, there is shown a torque transmitting device 10 according to the invention connected between a drill collar 12 and a PDC drag-type drill bit 14.

The device 10 comprises a first member 16 having at its upper end a threaded pin 18 which, in conventional manner, threadedly engages a socket in the lower end of the drill collar 12. Extending downwardly from the pin 18 is a hollow shaft 20.

The second member 22 of the device comprises a tubular sleeve 24 which surrounds and is spaced from the shaft 20 and is formed at its lower end with an internally threaded socket 26 which receives the conventional tapered threaded pin 28 on the drill bit 14.

Drilling fluid pumped down the drill string passes along the interior of the hollow shaft 20, through a passage 30 in the lower end of the member 22 and through a central passage in the drill bit so as, in known manner, to emerge from nozzles in the lower face of the drill bit from where it passes outwardly over the face of the bit and upwardly through the annulus between the drill string and the surrounding wall of the borehole.

An annular bottom flange 32 extends outwardly from the lower end of the hollow shaft 20 and bears on the annular surface surrounding the passage 30 so as to transmit weight-on-bit from the first member 16 through the second member 22 to the drill bit. An annular friction element 31 is located in an annular recess on the underside of the flange 32, and incorporates an O-ring seal 33 to prevent outward leakage of fluid from the interior of the hollow shaft 20.

A top flange 34 extends outwardly adjacent the upper end of the shaft 20 and is engageable with screws 36 projecting inwardly from the inner surface of the sleeve 24. This transmits to the second member 22 upward forces applied to the first member 16, for example when the bottom hole assembly is withdrawn from the borehole. The tapering of the screws also urges the member 22 downwards to compress the O-ring seal 33.

As best seen in FIG. 2, the shaft 20 of the first member 16 is formed with four equally spaced axially extending vanes 38 which are interspaced between inwardly extending longitudinal vanes 40 on the surrounding sleeve 24. Radial location of the sleeve 24 on the shaft 20 can be provided by close sliding contact between the outer extremities of the vanes 38 and the internal surface of the sleeve 24 and/or by close engagement of the outer peripheries of the upper and lower flanges 34, 32 with the inner surface of the sleeve 24.

There is disposed between each vane 38 and the vane 40 on the leading side thereof with respect to the direction of rotation (indicated by the arrows 42) an elongate body 44 of rubber or other suitable resiliently flexible material. The bodies of rubber 44 extend for the whole length of the shaft 20, between the flanges 32, 34. Each body 44 may be freely located between the adjacent vanes or may be bonded to one or other of the vanes. Preferably, however, each body 44 is bonded only to the vane 40 on the sleeve 24, as shown in FIG. 2.

In operation during drilling, the shaft 20 of the upper member 16 is rotated clockwise as seen in FIG. 2. The bodies 44 of rubber are compressed and the clockwise torque is transmitted through the bodies of rubber to the sleeve 24 and hence to the drill bit 14. Torsional vibrations in the drill string and drill collar 12 are damped by the bodies 44.

If, as a result of such vibrations, or for any other reason, the drill string momentarily rotates in the reverse, anti-clockwise direction, the freedom of movement of the vanes 38 between the vanes 40 enables the shaft 20 to rotate in the reverse direction, anti-clockwise relative to the sleeve 24. If, as in the preferred arrangement, the rubber bodies 44 are free or bonded to only one of the adjacent vanes, the bodies provide no restraint to this reverse rotation of the shaft 20 so that the reverse rotation is not transmitted to the drill bit, thereby avoiding the damage to the drill bit cutters which can occur as a result of such reverse rotation.

In the arrangement shown there is no significant restraint to reverse rotation of the vanes 38, but arrangements are possible where some restraint is provided, although according to the invention such restraint is less than the restraint to forward rotation provided by the bodies 44. For example, bodies of much lower modulus of elasticity than the bodies 44 may be provided between each vane 38 and the following vane 40.

Also, other resiliently flexible means may be provided between adjacent vanes instead of the bodies of resiliently flexible material. For example springs or other resilient devices may be provided between the vanes.

Frictional contact between components of the two members 16 and 22 may contribute to the torsional damping effect of the device 10. In particular, the frictional element 31 between the underside of the lower flange 32 and the surface surrounding the passage 30 will have a damping effect.

In use, the whole interior space between the shaft 20 and the sleeve 24 will fill with the pressurized drilling fluid, and the presence of this fluid may provide some hydraulic damping if the gaps between the extremities of the vanes 38,40 and the adjacent surfaces is small.

Figure 3:
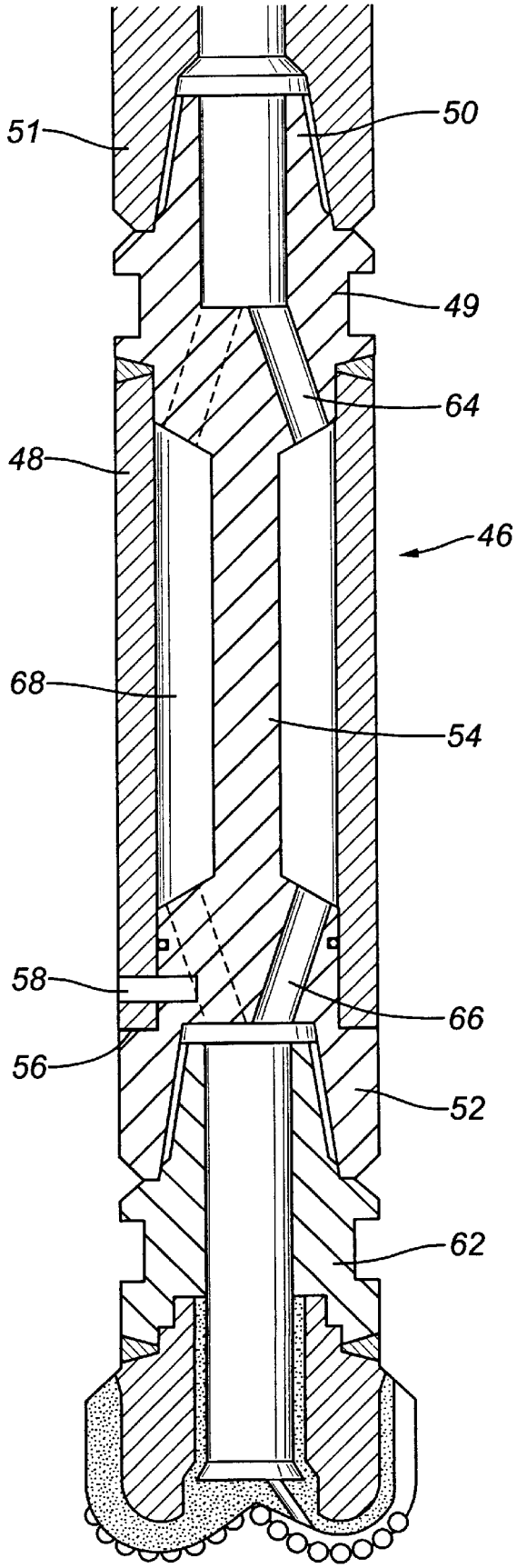
FIG. 3 is diagrammatic longitudinal section through an alternative embodiment

In the alternative arrangement shown in FIGS. 3, the torque transmitting device 46 comprises a tubular sleeve 48 which is welded at its upper end to a shank 49 having a threaded pin 50 connected to the drill collar 51. The shank 49 is connected to a lower member 52 by a torsion bar 54 which extends axially through the tubular sleeve 48.

Figure 4:
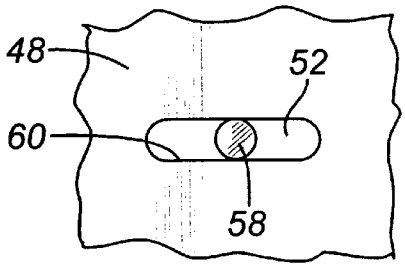
FIG. 4 is a side view, on an enlarged scale, of a part of the device of FIG. 3.

The lower end of the sleeve 48 is rotatable in an annular rebate 56 on the member 52 and radial pins 58 extend outwardly from the member 52 through horizontal peripheral slots 60 in the sleeve 48 as shown in FIG. 4. The drill bit 62 is connected to the lower end of the member 52.

Passages 64 and 66 convey drilling fluid into and out of the annular space 68 between the torsion bar 54 and the surrounding sleeve 48, so that it may pass to the drill bit 62.

Torque is transmitted from the drill collar 51 to the drill bit 62 through the inner torsion bar 54 of the device which also provides torsional flexibility. Torque is also transmitted through friction between the lower end of the sleeve 48 and the annular rebate 56 in the lower member 52. Suitable frictional material may again be used at this junction to provide the required frictional damping characteristics.

As in the previously described arrangement the device 46 damps transmission of torsional oscillations in the drill string to the bit 62, thus reducing any tendency for the cutters of the drill bit to experience damaging reverse rotation.

In a modification of the arrangement shown in FIG. 3, one or more bodies of resiliently flexible material, such as rubber, may be attached between the inner torsion bar 54 and the outer sleeve 48. This would provide an additional torque carrying capacity as well as additional damping. Such an arrangement would require the device to be provided with additional passages to allow the flow of drilling fluid through the device to the drill bit.

Figure 5:
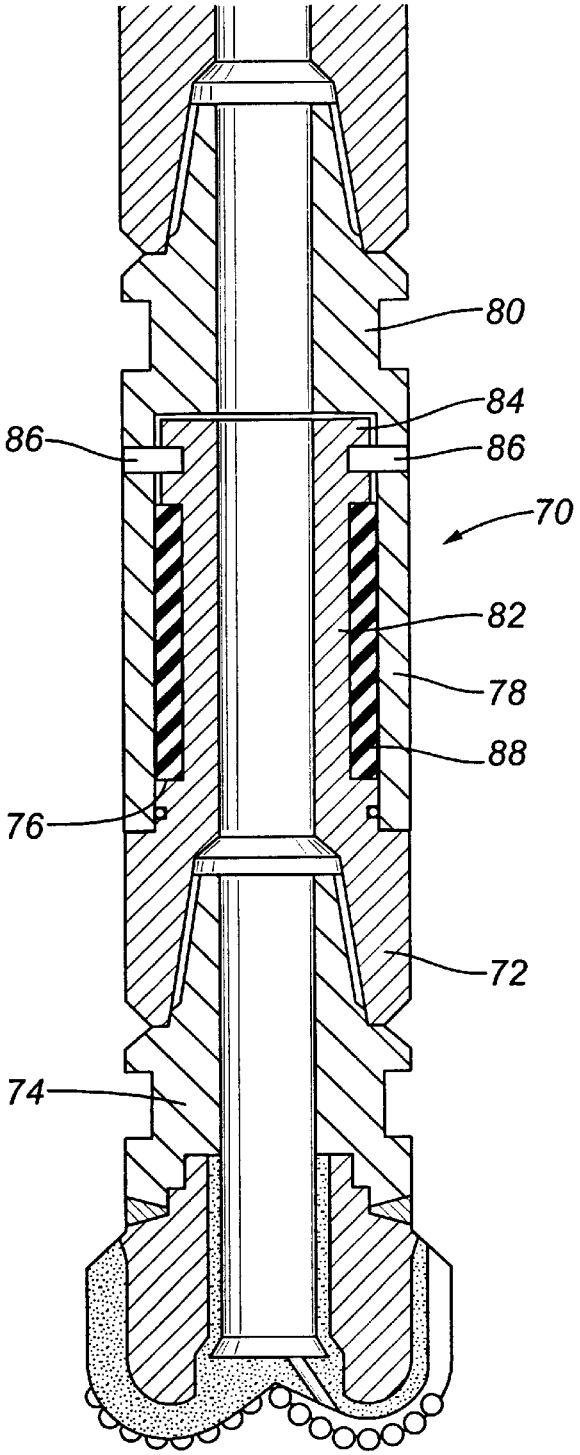
FIG. 5 is a diagrammatic longitudinal section through a further embodiment of the invention.

In the device 70 of FIG. 5, the lower member 72, connected to the drill bit 74, is again formed with an annular rebate 76 which receives the lower end of a tubular sleeve 78 on the upper member 80. In this case, however, the lower member 72 is formed with a hollow shaft 82 which extends up through the sleeve 78 and is provided at its upper end with a head portion 84 having outwardly extending radial pins 86 which engage in horizontal peripheral slots in the sleeve 78, in similar fashion to the arrangement of FIG. 4. This permits limited relative rotation between the upper member 80 and lower member 72.

The annulus between the outer sleeve 78 and the inner shaft 82 is filled with a resiliently flexible material 88, such as rubber, which is bonded to both the shaft 82 and the sleeve 78 so that torque is transmitted from the member 80 to the member 72 through this resiliently flexible material. The flexible material provides torsional flexibility and torsional damping and additional torsional damping is provided by friction at the junction between the lower end of the sleeve 78 and the annular rebate 76.

Weight-on-bit is transmitted through engagement of the sleeve 78 with the rebate 76, and engagement of the pins 86 within the peripheral slots in the sleeve 78 ensures that the two members of the device remain attached together as one unit should the flexible material 88 fail.

Whereas the present invention has been described in particular relation to the drawings attached hereto, it should be understood that other and further modifications, apart from those shown or suggested herein, may be made within the scope and spirit of the present invention.

What is claimed:

1. A torque transmitting device for use with a rotary drill bit connected to a drill collar, comprising:

a first member for connection to the drill collar, a second member for connection to the drill bit, coupling means connecting the first and second members together for rotation about a common central axis, said coupling means permitting limited relative rotation of the first member relative to the second member, about said axis, in both a forward drilling direction and in a reverse direction from a neutral position when the device is non-rotating and said coupling means providing a resistance to rotation of the first member relative to the second member in said forward drilling direction from said neutral position which is greater than its resistance to relative rotation in said reverse direction.

2. A torque transmitting device according to claim 1, wherein the coupling means provides substantially no restraint to rotation of the first member relative to the second member in the reverse direction, other than frictional restraint arising from relative rotation between components of the device.

3. A torque transmitting device according to claim 1, wherein the coupling means includes resiliently flexible means to oppose rotation of the first member relative to the second member in said forward drilling direction and to transmit torque to the second member in that direction.

4. A torque transmitting device according to claim 1, wherein said coupling means include abutments, on the two members respectively, which transmit torque from the first member to the second member in the forward drilling direction, but which abutments are freely separable upon rotation of the first member in the reverse direction relative to the second member.

5. A torque transmitting device according to claim 1, wherein the two members of the device include at least one pair of frictionally engaging surfaces which slide relatively over one another upon relative rotation between the members.

6. A torque transmitting device for use with a rotary drill bit connected to a drill collar, comprising:

a first member for connection to t he drill collar, a second member for connection to the drill bit, and coupling means connecting the first and second members together for rotation about a common central axis and permitting limited relative rotation between the members about said axis, said coupling means providing a resistance to rotation of the first member relative to the second member in a forward drilling direction which is greater than its resistance to relative rotation in a reverse direction and said coupling means including at least one body of resiliently flexible material disposed between abutments on the first and second members respectively, to oppose rotation of the first member relative to the second member in said forward drilling direction and to transmit torque to the second member in that direction.

7. A torque transmitting device according to claim 6, wherein the body of resiliently flexible material provides resistance to movement of said abutments towards one another, but less resistance to movement of the abutments away from one another.

8. A torque transmitting device according to claim 7, wherein at least one of the abutments is unattached to the body of resiliently flexible material, so that the body may separate from at least one of the abutments as they move apart.

9. A torque transmitting device according to claim 6, wherein the abutments comprise outwardly extending radial vanes on one member interspaced between inwardly extending radial vanes on the other member.

10. A torque transmitting device according to claim 19, wherein the vanes and body of resiliently flexible material extend generally parallel to the common central axis of the members.

11. A torque transmitting device according to claim 6, wherein the coupling means provides substantially no restraint to rotation of the first member relative to the second member in the reverse direction, other than frictional restraint arising from relative rotation between components of the device.

12. A torque transmitting device for use with a rotary drill bit connected to a drill collar, comprising:

a first member for connection to the drill collar, a second member for connection to the drill bit, and coupling means connecting the first and second members together for rotation about a common central axis and permitting limited relative rotation between the members about said axis, said coupling means providing a resistance to rotation of the first member relative to the second member in a forward drilling direction which is greater than its resistance to relative rotation in a reverse direction and said coupling means including resilient means disposed between abutments on the first and second members respectively, to oppose rotation of the first member relative to the second member in said forward drilling direction and to transmit torque to the second member in that direction.

13. A torque transmitting device according to claim 12, wherein the resilient means provides resistance to movement of said abutments towards one another, but less resistance to movement of the abutments away from one another.

14. A torque transmitting device according to claim 12, wherein the resilient means provides substantially no restraint to rotation of the first member relative to the second member in the reverse direction, other than frictional restraint arising from relative rotation between components of the device.

15. A torque transmitting device according to claim 14, wherein at least one of the abutments is unattached to the resilient means, so that the resilient means may separate from at least one of the abutments as they move apart.

16. A torque transmitting device according to claim 12, wherein the abutments comprise outwardly extending radial vanes on one member interspaced between inwardly extending radial vanes on the other member.

17. A torque transmitting device according to claim 16, wherein the vanes extend generally parallel to the common central axis of the members.

18. A torque transmitting device according to claim 12, wherein the two members of the device include at least one pair of frictionally engaging surfaces which slide relatively over one another upon relative rotation between the members.

* * * * *